US005749198A

United States Patent [19]

Johnson

[11] Patent Number: 5,749,198

[45] Date of Patent: May 12, 1998

[54] TAPERED COMPOSITE ELEVATED SUPPORT STRUCTURE

[75] Inventor: David W. Johnson, San Diego, Calif.

[73] Assignee: Ebert Composites Corporation, San Diego, Calif.

[21] Appl. No.: 128,800

[22] Filed: Sep. 28, 1993

Related U.S. Application Data

[63] Continuation-in-part of Ser. No. 7,079, Jan. 29, 1993, Pat. No. 5,319,901, Ser. No. 828,499, Jan. 31, 1992, Pat. No. 5,285,613, and Ser. No. 715,912, Jun. 14, 1991, Pat. No. 5,247,774, which is a continuation-in-part of Ser. No. 541,547, Jun. 21, 1990, Pat. No. 5,024,036, which is a continuation-in-part of Ser. No. 231,379, Aug. 12, 1898, Pat. No. 4,991,726, which is a continuation-in-part of Ser. No. 137,101, Dec. 23, 1987, Pat. No. 4,809,146, and Ser. No. 137,100, Dec. 23, 1987, Pat. No. 4,825,620, which is a continuation-in-part of Ser. No. 848,573, Apr. 7, 1986, Pat. No. 4,715,503, said Ser. No. 137,101, is a continuation-in-part of Ser. No. 848,573.

[51] Int. Cl.[6] ..... E04H 12/02

[52] U.S. Cl. ..... 52/651.04; 52/651.02; 52/697; 52/309.14; 174/45 R; 403/171

[58] Field of Search ..... 52/309.1, 309.14, 52/648.1, 651.02, 651.04, 697; 174/45 R; 403/171

[56] References Cited

U.S. PATENT DOCUMENTS

| | | | |
|---|---|---|---|
| 965,185 | 7/1910 | Hickman | 52/651.02 X |
| 3,100,555 | 8/1963 | Ashton | 52/309.1 X |
| 3,291,899 | 12/1966 | Ward et al. | 52/697 |
| 3,509,678 | 5/1970 | Dake | 174/45 R X |
| 3,571,991 | 3/1971 | Dooey et al. | 52/651.02 X |
| 3,574,104 | 4/1971 | Medler | 174/45 R X |
| 3,959,946 | 6/1976 | Holmes et al. | 52/736.1 X |
| 3,968,602 | 7/1976 | Mitchell | 52/697 X |
| 4,246,732 | 1/1981 | Frehner | 52/309.1 |
| 4,569,165 | 2/1986 | Baker et al. | 52/309.1 X |
| 4,769,967 | 9/1988 | Bourrieres | 174/45 R X |
| 4,803,819 | 2/1989 | Kelsey | 52/101 X |
| 4,934,114 | 6/1990 | Lindsey | 52/651.02 X |
| 5,285,613 | 2/1994 | Goldsworthy | 403/171 X |
| 5,319,901 | 6/1994 | Goldsworthy et al. | 52/651.02 |
| 5,617,692 | 4/1997 | Johnson et al. | 52/651.02 |

FOREIGN PATENT DOCUMENTS

| | | | |
|---|---|---|---|
| 38867 | 2/1924 | Norway | 52/697 |

*Primary Examiner*—Carl D. Friedman
*Assistant Examiner*—Kevin D. Wilkens

[57] ABSTRACT

A high voltage electrical transmission line support structure is constructed virtually completely from glass reinforced composites, comprised of vertical ribs, reinforcing cross bracing members and a skin composed of composite panels, enabling the reduction in elevation and closer spacing of conductors, and the creation of a smaller support structure weighing half or less the weight of a steel tower of the same power rating. The resulting structure requires substantially less ground right-of-way, and EMF radiation is attenuated in the immediate tower area due to the closer phase spacing.

1 Claim, 4 Drawing Sheets

Fig. 3
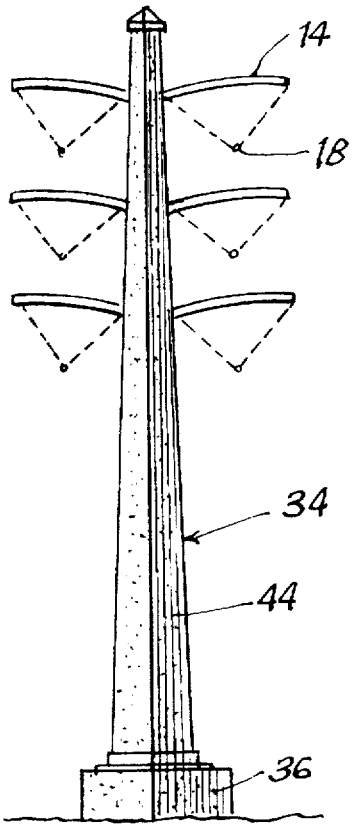
Fig. 4
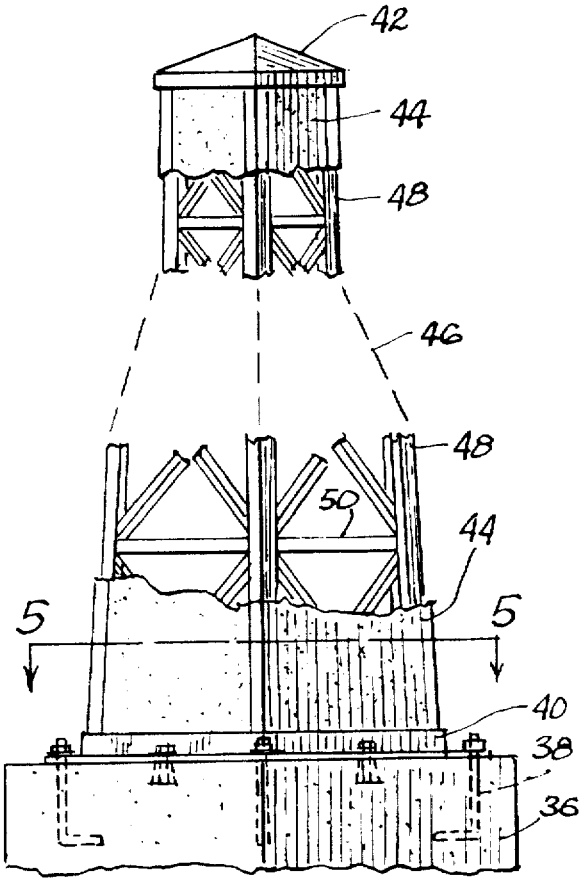
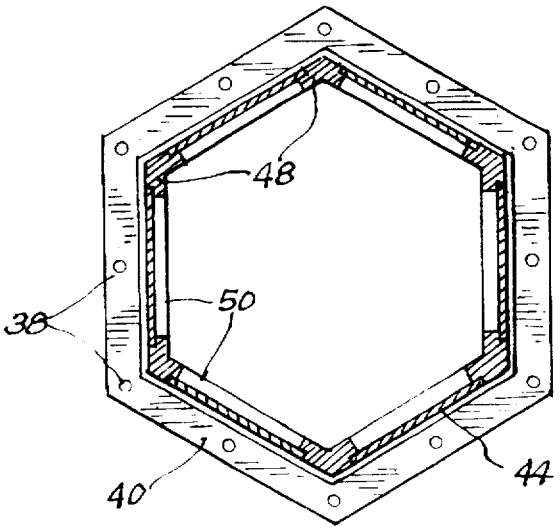
Fig. 5

TAPERED COMPOSITE ELEVATED SUPPORT STRUCTURE

BACKGROUND OF THE INVENTION

The disclosed structure is a Continuation-In-Part of U.S. Pat. application No. 715,912 filed Jun. 14, 1991, issuing Sep. 28, 1993, as U.S. Pat. No. 5,247,774 on a TOWER CONSTRUCTED OF PULTRUDED COMPOSITES. That patent was a continuation in part of U.S. application No. 07/541,547 filed Jun. 21, 1990, issued on Jun. 18, 1991 as U.S. Pat. No. 5,024,036 on an invention entitled INTERLOCKING SUPPORT STRUCTURES, which was a Continuation-in-Part of U.S. application No. 07/231,379 filed Aug. 12, 1988, issued on Feb. 12, 1991 as U.S. Pat. No. 4,991,726 on an invention entitled SUPPORT STAND, that was a Continuation-in-Part of both: U.S. application No. 07/137,101 filed Dec. 23, 1987, issued on Feb. 28, 1989, as U.S. Pat. No. 4,809,146 on an ENCLOSURE WITH INTERLOCKING FRAME JOINTS and U.S. application No. 07/137,100 filed Dec. 23, 1987, issued on May 2, 1989 as U.S. Pat. No. 4,825,620, on a ATRUCTURAL SUPPORT OF INTERLOCKING LATTICE CONSTRUCTION, both of which were Continuations-in-part of U.S. application No. 06/848,573, filed Apr. 7, 1986, issued Dec. 29, 1987 as U.S. Pat. No. 4,715,503 on an INTERLOCKING JOINT WINE RACK. This application is also a Continuation-In-Part of U.S. application No. 08/007,079 filed Jan. 29, 1993, issued Jun. 14, 1994 as U.S. Pat. No. 5,319,901, on a Bifurcated Column Joint System For Electrical Transmission Tower and U.S. application No. 07/828,499 filed Jan. 31,1992, issued Feb. 15, 1994 as U.S. Pat. No. 5,285,613, on a Pultruded Joint System and Tower Structure Made Therewith. The parent invention combined the fields of high voltage transmission towers and pultruded composite construction, and continued a series of developments relating to the fabrication of relatively large structures formed from pultruded composites. Particular attention was directed toward the development of effective joining techniques in a field in which steel construction has dominated, but using materials for which the steel joining techniques of bolting and welding are unsuitable.

A composite can be laid up as layers of fibers or fiber cloth or cords bonded with a polymer resin, or in some applications it can be pultruded. A pultruded composite is made by drawing a bundle of fibers through a resin bath and then through a die, in which it is heat-cured to a smooth, hard member that is usually a thermal and electrical insulator as well as being resistant to corrosive chemicals. The resulting product is tough and virtually immune from corrosion and chemical deterioration.

Currently, virtually all transmission towers are made of steel. However, certain undesirable performance limitations are inherent in steel, the foremost being high electrical conductivity. Inasmuch as it is the role of the tower to support, and isolate from ground, conductors carrying 200,000 volts or more, the towers must be large, both to separate the individual conductors from each other and from the steel structure, and to accommodate inter-tower line sag. The high conductivity of the steel structural supports mitigates against these goals, increasing flashover potential and posing a chronic safety hazard to the line maintenance crew as well. Steel towers also inevitably suffer from deterioration from rust and corrosion and must be coated regularly and eventually replaced, often at great expense if the site is remote and inaccessible.

A consideration involving transmission towers of current and increasing concern regards the powerful electromagnetic field (EMF) in the immediate vicinity of the lines. EMF is suspected of being linked to cancer in humans who live or work under the conductors on a daily basis. Whether or not this alleged link is ever substantiated, the current public perception that it may be true causes problems right now, involving land values, lawsuits, the anxiety for property owners and those who work or dwell in the immediate vicinity of high voltage lines. While steel used in towers may not directly enhance EMF radiation, partly due to its conductivity the out-of-phase conductors must be widely spaced apart, which minimizes the flashover potential but also reduces the natural phase cancellation that can be achieved with compact electrical conductors. These factors warranted consideration of alternative techniques and materials for tower construction, and composites have characteristics that make them worth investigating.

Certain problems must be overcome when using composites in place of steel, or in place of wood in the case of utility poles. Paramount among these is the difficulty of joining composite members with structurally sound joints. When composite members are fastened with conventional fasteners such as bolts and screws, joint strength is generally unacceptable. This problem has been met and largely overcome in the disclosure of the parent patent and other related applications filed by applicant which disclose ways of engaging cross members in specially designed corner columns without the need for holes or bolts.

Another challenge in using pultruded composites for structural members stems from the nature of the pultrusion process. Pultrusion is an ideal process for making infinitely long, strong members of uniform cross-section with very low production costs beyond materials costs. However, the pultruded product has no taper, and current state-of-the-art techniques fail to provide for tapered members and possibly never will. When making tall structures such as utility poles or towers however, it is necessary or desirable to taper the structure for weight reduction and optimum resistance to bending moments, not to mention aesthetics near urban centers. A utility tower or tall pole having the same planform dimensions top-to-bottom would be a poor design.

It is the purpose of this disclosure to address the problem of using constant-planform pultrusions to produce a general purpose elongated tower- or pole-type structure completely tapered despite the fact that it is composed entirely of pultruded members.

SUMMARY OF THE INVENTION

The invention may be used in any application in which a tall supporting structure is required, and preferably in an application in which the beneficial qualities of high dielectric constant, relatively high strength -to-weight ratio and corrosion resistance are desirable. Typical uses are for a radio or microwave, etc., tower, a utility pole and a high-voltage transmission tower, all of which are made substantially completely from composite pultrusions. These implementations have the advantage of superiority to steel in size and weight for the same performance, weighing about half as much as an equivalent conventional steel structure and having overall dimensions on the order of two-thirds of comparable current configurations of steel towers in the high-voltage tower embodiment. The narrower right-of-way required for a transmission line supported by these compact towers and the reduction of EMF resulting from the elevated level of phase cancellation due to the narrower spacing between the conductors is realized by the tower configuration. For smaller structures, the advantages of greater longevity inherent in the highly chemical- and UV-resistant composite poles can be enjoyed without being relegated to a member that must be equally wide at the top as at the bottom.

To achieve these advantages, the disclosed construction uses pultruded ribs which themselves are of uniform cross-section, but which are tapered uniformly or in a curve to optimize the overall configuration and permanently restrained in the tapered shape by a monocoque outer sheathing or an internal rigidifying structure, or both.

BRIEF DESCRIPTION OF THE DRAWINGS

FIG. 3 is a front elevation view of the tower of FIG. 1 shown in greater detail;

FIG. 4 is a vertically compressed elevation view of the structure shown with the central portion omitted and a portion of the skin torn away to reveal the interior support structure;

FIG. 5 is a section taken along line 5—5 of FIG. 4;

DETAILED DESCRIPTION OF THE PREFERRED EMBODIMENT

A typical prior art tower is indicated at 10. It consists of a tapered steel structure 12, with extended support arms 14. Strings of insulators indicated at 16 support the power lines 18. A "peak" 20 supports one or more lightning shield wires, not shown. The structure in FIG. 2 is all fabricated steel, is generally multi-sided, and is welded together on several edges.

Figure 1:
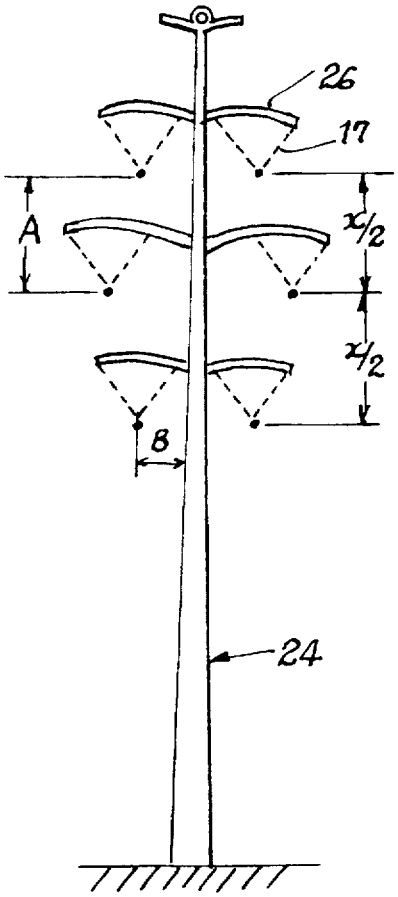
FIG. 1 is a somewhat diagrammatic front elevation view of a support made according to the invention.

The invention is shown in FIG. 1. Although similar in appearance to the prior art in the illustrated embodiment, it is vastly different, being made of pultruded composites. The towers of FIGS. 1 and 2 are configured in conformity to industry standard specfications for towers supporting high voltage wire conductors intended to carry 69 kilovolts and above, with the wires spaced apart minimum distances X in the steel version of FIG. 2 and X/2 in the composite version as predetermined by industry standards applicable to the 69-KV voltage class and above. The conductor-to-tower spacing minimum for towers in this class is indicated at B in FIG. 1, which is about half of the comparable spacing in the steel tower (the spacing is not indicated by number or letter in FIG. 2).

The industry standards for the spacing of the phases, or individual conductors, is fairly narrowly defined by the line voltage rating. The rule is expressed as, the wet-insulation flashover should be four times the line-to-ground voltage. For example a three-conductor tower carrying 345 kilovolts is first divided by the square root of three, which equals approximately 200 kilovolts. Since four times two hundred equals 800 kilovolts, an insulator string is selected to space the conductor from the metal tower sufficiently to have a minimum of 800 kilovolt flashover with wet insulation. At 345 kv, the conductors must be approximately 110 inches from ground potential, which includes all of the tower in addition to the actual ground. Referring to the drawing of FIG. 1, a form of the new tower 24 can be seen as compared to the standard equivalent metal tower 10 of FIG. 2. By eliminating the conductive material in the tower, it can be seen that the wires can be brought in to approximately half of their former spacing in the new composite tower, from spacing "X" in the steel tower to "½ X" in the composite tower. The same approximate ratio of reduction in spacing applies to the conductor-to-frame spacing and the vertical conductor-to-conductor spacing.

Figure 2:
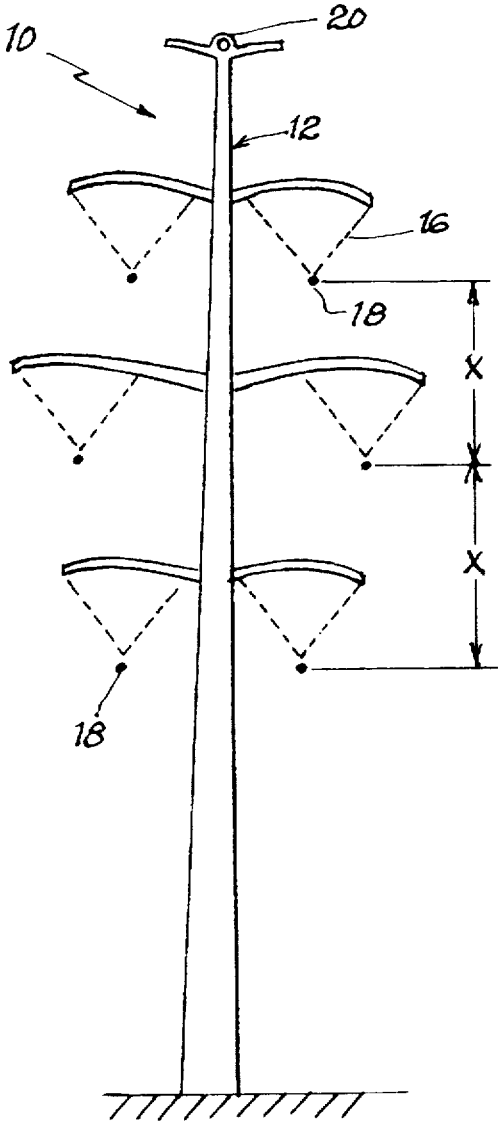
Fig. 2 (Prior Art)
FIG. 2 is an elevation view of a prior art tower which is visually similar to the composite tower of FIG. 1 but is fabricated of steel.

This same efficiency in spacing is apparent in FIG. 1 as the tower 24 is approximately 80% as high as the tower of FIG. 2. The closest conductor to ground level, 18, remains at the same height in both configurations, to ensure with conductor sag, the minimum safe height above ground level is achieved. However, in FIG. 1, a compaction of conductors, or phases, is possible because the tower is a fully insulative composite and the design criteria of minimum flashover, phase-to-ground, is no longer a limiting criteria. Thus the lengths of the insulators 17 in FIG. 1 are half the length of the insulators 16 in FIG. 2.

The insulator length of FIG. 1 could be reduced to half the typical length required of a steel tower as shown, but it could alternatively be eliminated as a separate unit. This could be achieved by adding silicone rubber sheds (not shown), a common "tracking" resistant skirt material used in high voltage polymer insulators, to extended rods which are an integral structure of the tower at points such as that indicated at 26 in FIG. 1. In lieu of separate insulators, the sheds that are generally installed on insulator rods will be installed directly on a portion of the tower adjacent to the attachment point of the conductor. This attachment point is shown on just one arm of the tower in FIG. 1 at 26 but would of course replace all of the hanging insulators.

By compacting the conductors, the tower height is reduced, the right-of-way owned by the entity transmitting electricity is more compact, energy is transmitted more efficiently due to lower inductive reactance, the electromagnetic field (EMF) at ground level is reduced, and further reduction in weight is achieved.

Figure 6:
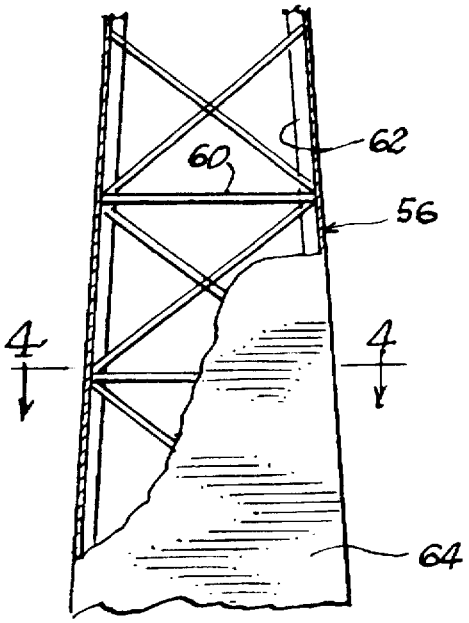
FIG. 6 is an elevation view partially in section of a central fragmentary portion of the structure with the skin partially peeled away.

FIG. 3 shows a front elevation of the tower 34 which is installed on a concrete foundation pad 36 with bolts 38 through a flange 40. A cap 42 is shown on the top of the tower to prevent moisture from entering the structure. Although only three conductors 18 and cross arm supports 14 are required for a single circuit, many times two circuits are strung through a right-of-way and this requires, in three phase systems, the six cross arms 14 and six conductors 18 shown in FIG. 3. From external appearances the tapered trunk structure of FIG. 3 would look like any typical steel tapered pole that is currently fabricated hollow with substantially thick walls. The difference is the composite tapered trunk structure of FIG. 3 is made with an external skin 44 which is bonded or fastened to an internal array of cross members and longitudinal ribs, not unlike the composite cross members and support legs of the previously referenced patent. This external skin is an aesthetic covering, however its primary purpose is structural. The external skin 44 absorbs bending stresses, in addition to the internal cross members and longitudinal ribs, and allows a narrower taper, and thus smaller foundation area, than would be required without the external skin. The external skin 44 is pultruded composite material fabricated in continuous sheets and then machined in a tapered trapezoidal shape. The ribs and cross bracing members define trapezoidal sections as shown in FIG. 6, with the four faces together defining one of several vertically consecutive cells with vertically aligned cell faces defining continuous trunk faces. The trapezoidal skin panels are mounted over said respective trunk faces in one embodiment, as shown in FIG. 4, fitting thereon one-to-one.

FIG. 4 shows an elevation view of the tapered composite support structure 34 with the top and bottom of the structure shown and the missing central portion indicated as dashed line 46. Shown in this figure is the external skin 44 and the internal longitudinal ribs 48 and cross members 50. Also shown is the foundation 40, foundation tie down bolts 38 and the cap 42. There are six longitudinal ribs in the structure of FIG. 4, although the number of ribs could vary from three to eight or more. Section 5—5 of FIG. 4 is shown in FIG. 5 to illustrate this.

FIG. 5 shows internal details of the tapered composite elevated support structure. Six longitudinal ribs 48 have cross members 50 interconnected with the ribs and having snap-in detent structure cooperating with mating brace detent structure defined by the cross bracing members such that the ribs and cross bracing structure interconnect substantially without fasteners. The ribs are designed to interface with the cross members at 120 degrees angle and are unique for a six sided structure. The external skin 44 is shown, which as stated is trapezoidal and extends the entire length of the trunk structure either as consecutive trapezoids or as a single monolithic panel. Also shown is the mounting flange 40 and the mounting bolts 38.

FIG. 6 is an elevation view of a four sided tapered composite elevated support structure 56 with external skin 64 and internal longitudinal ribs 62 and internal cross members 60.

Figure 7:
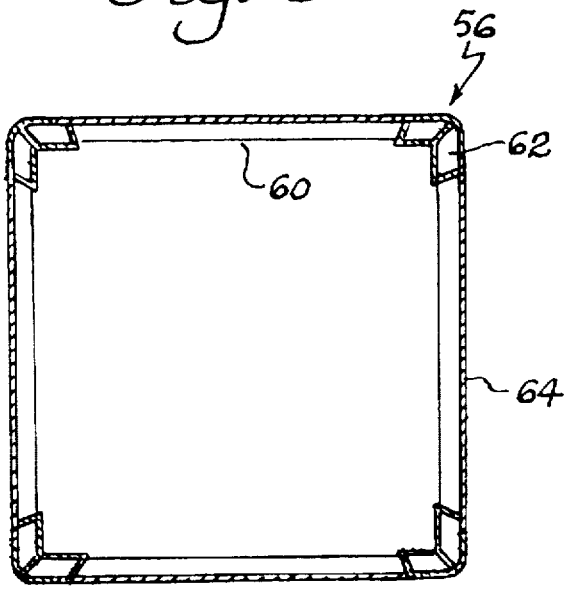
FIG. 7 is a diagrammatic horizontal section taken through a structure similar to that of the remaining figures but square in cross-section; and, FIG. 8 is a somewhat diagrammatic horizontal cross section through the hexagonal unit illustrating only the braces and skin and sections of the vertical members.

FIG. 7 is a cross section 4—4 of FIG. 6. Shown in cross section are the four longitudinal ribs 62, which as stated are unique for this application, that is a four sided tapered composite elevated support structure. Shown also are the internal cross members 60 and the external skin 64.

Figure 8:
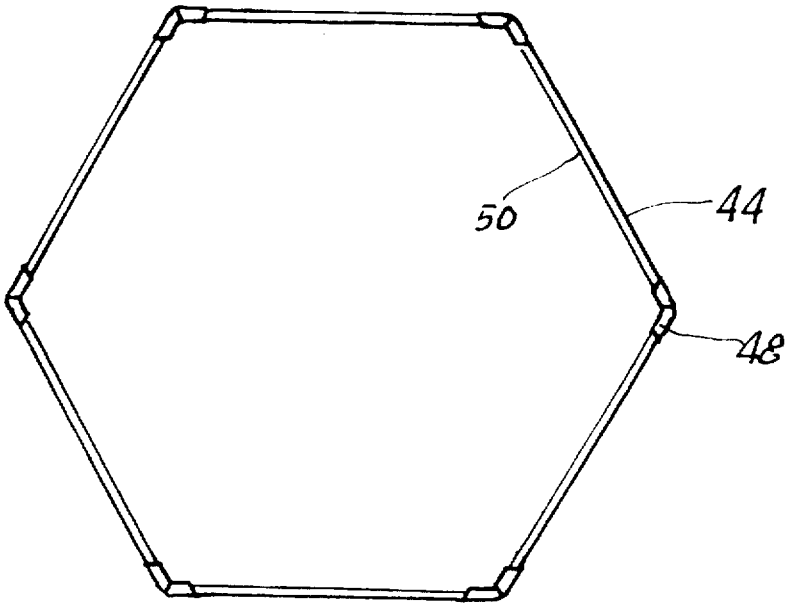

FIG. 8 shows an alternate configuration of a cross section of a six sided structure with longitudinal ribs 48, cross members 50 and skin 44.

Figure 9:
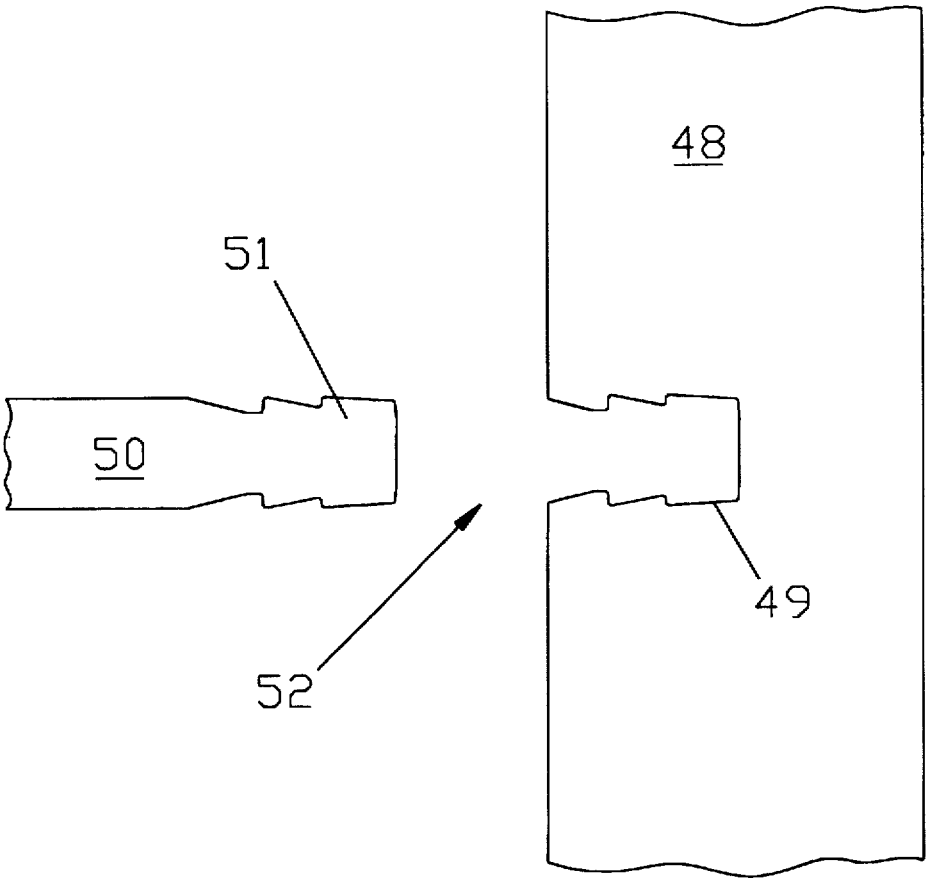
FIG. 9 is an exploded side elevation view illustrating the manner in which the horizontal cross members are interconnected with the upright longitudinal ribs.

FIG. 9 is an exploded side elevation view that illustrates the manner in which the longitudinal ribs 48 and cross members 50 in FIG. 4 are secured to each other. The snap-in detent structure 52 is comprised of the tip 51 on cross member 50 that is received in recess 49 of longitudinal ribs 48.

It is hereby claimed:

1. A high voltage electrical transmission line support structure for use in areas where maximum limits on EMF at the ground level are desirable in the vicinity of transmission lines comprising:

(a) a vertically oriented tapered trunk having a peaked top end and a bottom end, said tapered trunk having:

(i) at least three longitudinal ribs converging from a wider stance at said bottom end to a converging peak at said top end, and, (ii) a plurality of cross bracing members interconnecting said ribs and substantially rigidifying same;

(iii) a rigid external structural skin substantially completely sheathing and enclosing said ribs and cross bracing members substantially completely from said top end to said bottom end to produce a tower having an external appearance suggestive of a monolithic pole and said sheathing being integrally connected to said cross bracing members and said ribs such that said skin is monocoquely structurally reinforcing same;

(b) means for supporting at least three high-voltage wire conductors, for conducting at least partially mutually out-of-phase currents, adjacent the top portion of said tapered trunk in a predetermined configuration in which said high-voltage wire conductors are each spaced from the next closest of said wire conductors at least a minimum predetermined distance from said vertically oriented tapered support structure, at least a portion of said support structure including said external skin and substantially all of said internal cross bracing members in the vicinity of said three high voltage wire conductors being constructed of composite material permitting the compacting of said conductors whereby the resulting ground level EMF is reduced and said vertically oriented tapered support structure is formed with reduced vertical height compared to a tower constructed of steel with a comparable industry-standard voltage rating; and, said ribs having snap-in detent structure cooperating with mating brace detent structure defined by said cross bracing members such that said ribs and cross bracing structure interconnect substantially without fasteners.

* * * * *